US008936238B2

(12) United States Patent
Yamaguchi

(10) Patent No.: US 8,936,238 B2
(45) Date of Patent: Jan. 20, 2015

(54) SHEET CONVEYING APPARATUS, AND SHEET PROCESSING APPARATUS AND IMAGE FORMING APPARATUS PROVIDED WITH THE SAME

(71) Applicant: KYOCERA Document Solutions Inc., Osaka-shi, Osaka (JP)

(72) Inventor: Yoshihiro Yamaguchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/216,825

(22) Filed: Mar. 17, 2014

(65) Prior Publication Data

US 2014/0284868 A1 Sep. 25, 2014

(30) Foreign Application Priority Data

Mar. 19, 2013 (JP) ..... 2013-056368

(51) Int. Cl.

| | |
|---|---|
| ***B65H 3/44*** | (2006.01) |
| ***B65H 5/26*** | (2006.01) |
| ***B65H 5/00*** | (2006.01) |
| ***B65H 9/00*** | (2006.01) |

(52) U.S. Cl.

CPC .. *B65H 5/26* (2013.01); *B65H 5/00* (2013.01); *B65H 9/00* (2013.01)

USPC ..... 271/9.11; 271/9.13; 271/162

(58) Field of Classification Search

CPC ..... B65H 1/00; B65H 3/00; B65H 2405/15; B65H 2405/31; B65H 2405/312; B65H 2405/313; B65H 2405/33; B65H 2405/331; B65H 2405/3311; B65H 2405/332

USPC ..... 271/9.11, 9.12, 9.13, 162

See application file for complete search history.

(56) References Cited

U.S. PATENT DOCUMENTS

| | | | | |
|---|---|---|---|---|
| 5,102,112 | A * | 4/1992 | Takahashi | 271/9.08 |
| 5,265,869 | A * | 11/1993 | Morita | 271/274 |
| 5,299,794 | A * | 4/1994 | Yamada et al. | 271/9.11 |
| 5,379,101 | A * | 1/1995 | Takahashi et al. | 399/110 |
| 5,383,654 | A * | 1/1995 | Iseda | 271/9.05 |
| 5,624,108 | A * | 4/1997 | Kubo | 271/9.12 |
| 6,161,829 | A * | 12/2000 | Kusumi | 271/9.05 |
| 8,398,069 | B2 * | 3/2013 | Chae et al. | 271/9.08 |

(Continued)

FOREIGN PATENT DOCUMENTS

JP 2001122447 A 5/2001

*Primary Examiner* — David H Bollinger

(74) *Attorney, Agent, or Firm* — Alleman Hall McCoy Russell & Tuttle LLP

(57) ABSTRACT

A sheet conveying apparatus according to one aspect of the present disclosure includes a housing, a sheet storage portion, a sheet conveying path, and a guide member. Housing is mounted to apparatus body that includes bottom portion having opening portion, and main sheet conveying path extending upward from opening portion to convey sheets, and includes top face portion arranged opposing bottom portion. Sheet conveying path extends from sheet storage portion to top face portion, and is configured to be capable of communicating with main sheet conveying path. Sheets are conveyed on sheet conveying path. Guide member is pivotably supported by housing, and is configured to be capable of changing its position between a first position where guide member follows along top face portion and a second position where guide member projects upward from top face portion to guide sheet toward main sheet conveying path from sheet conveying path.

14 Claims, 10 Drawing Sheets

(56) References Cited

U.S. PATENT DOCUMENTS

2003/0025263 A1* 2/2003 Koga ..... 271/9.12
2006/0125172 A1* 6/2006 Hashimoto et al. ..... 271/9.01
2008/0180764 A1* 7/2008 Wakiyama et al. ..... 358/498
2012/0133096 A1* 5/2012 Yoshimura ..... 271/256

* cited by examiner

SHEET CONVEYING APPARATUS, AND SHEET PROCESSING APPARATUS AND IMAGE FORMING APPARATUS PROVIDED WITH THE SAME

INCORPORATION BY REFERENCE

This application is based upon and claims the benefit of priority from the corresponding Japanese Patent Application No. 2013-056368 filed on Mar. 19, 2013, the entire contents of which are incorporated herein by reference.

BACKGROUND

The present disclosure relates to a sheet conveying apparatus, and a sheet processing apparatus and an image forming apparatus provided with the same.

Conventionally, a sheet feed apparatus mounted to an apparatus body of an image forming apparatus has been known as a sheet conveying apparatus that conveys sheets. The sheet feed apparatus has a shape of a rectangular parallelepiped, and is mounted to an apparatus body of an image forming apparatus similarly having a shape of a rectangular parallelepiped. In most cases, the image forming apparatus is mounted on the sheet feed apparatus, and both apparatuses are fixed to each other.

The sheet feed apparatus includes a sheet storage portion therein. A sheet conveying path extends from the sheet storage portion to a top face portion of the sheet feed apparatus. On the other hand, a body-side conveying path is provided in the apparatus body of the image forming apparatus to extend upward from a bottom portion. When the image forming apparatus and the sheet feed apparatus are fixed to each other, the sheet conveying path and the body-side conveying path communicate with each other. As a result, sheets are fed to the image forming apparatus from the sheet feed apparatus.

Conventionally, a guide member provided to project from a top face portion of a sheet feed apparatus for sending a sheet from the sheet feed apparatus to an apparatus body of an image forming apparatus has been known. Since a leading end portion of the guide member projects toward the apparatus body of the image forming apparatus, the sheets can appropriately be sent.

SUMMARY

A sheet conveying apparatus according to one aspect of the present disclosure is attached to a lower part of an image forming apparatus which includes a bottom portion having an opening portion and a main sheet conveying path which extends upward from the opening portion. The sheet conveying apparatus includes a housing, a top face portion, a sheet storage portion, a sheet conveying path, and a guide member. The top face portion forms a top face of the housing, and includes an outlet portion arranged opposing the opening portion. The sheet storage portion is arranged inside the housing, and stores sheets therin. The sheet conveying path extends from the sheet storage portion to the outlet portion, and is configured to be capable of communicating with the main sheet conveying path through the opening portion. The sheets are conveyed on the sheet conveying path. The guide member is pivotably supported by the housing, and is configured to be capable of changing its position between a first position where the guide member follows along the top face portion and a second position where the guide member projects upward from the top face portion so as to guide the sheet toward the main sheet conveying path from the sheet conveying path.

An image forming apparatus according to another aspect of the present disclosure includes the sheet conveying apparatus, an apparatus body that includes a bottom portion formed with an opening portion and a main sheet conveying path extending upward from the opening portion to convey sheets, and an image forming portion that can form an image onto a sheet conveyed by the sheet conveying apparatus.

An sheet processing apparatus according to another aspect of the present disclosure includes the sheet conveying apparatus, and a sheet processing portion that can perform a predetermined process to a sheet conveyed by the sheet conveying apparatus.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
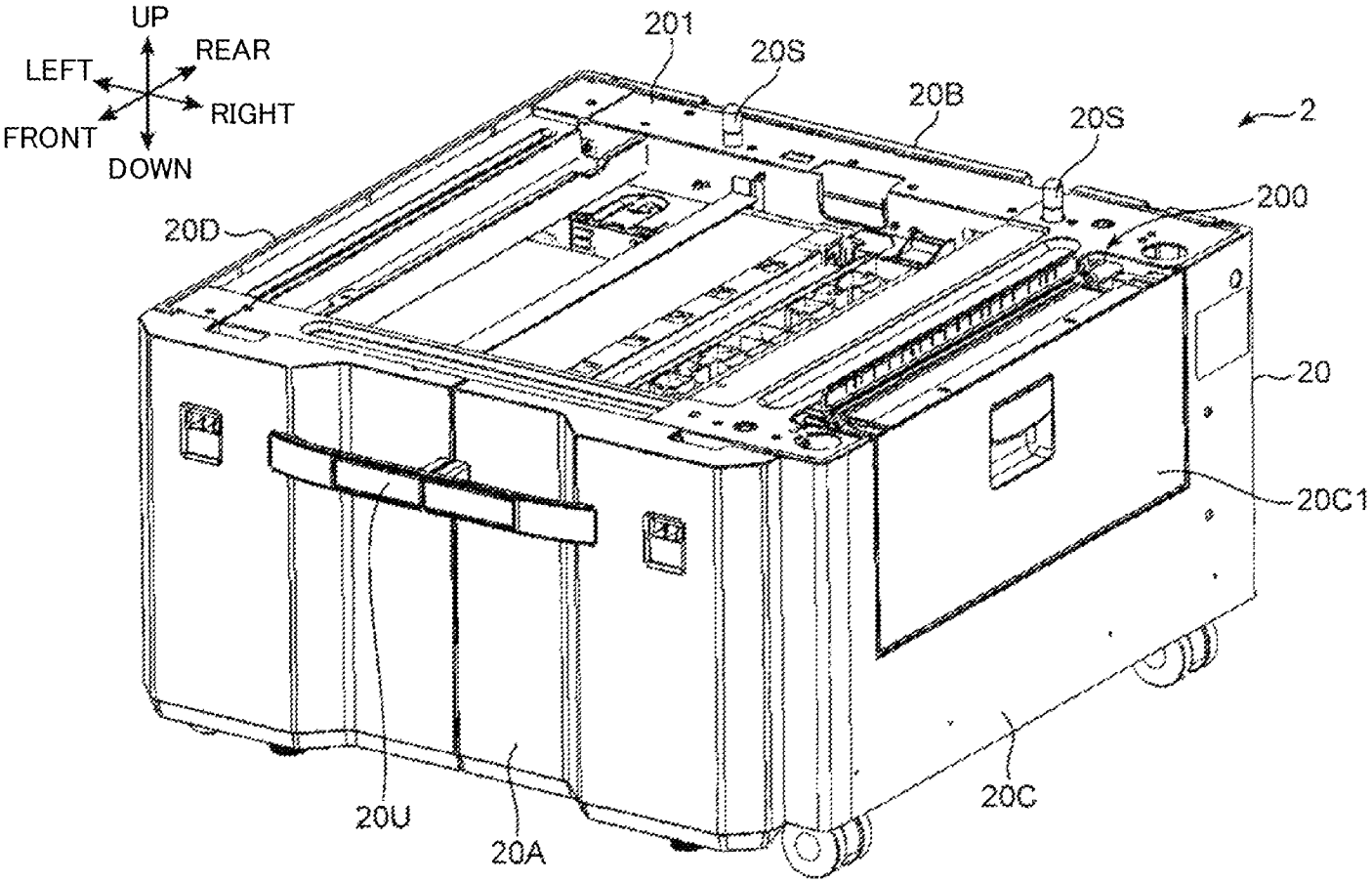
FIG. 1 is a perspective view of a sheet feed deck according to an embodiment of the present disclosure.
Figure 2:
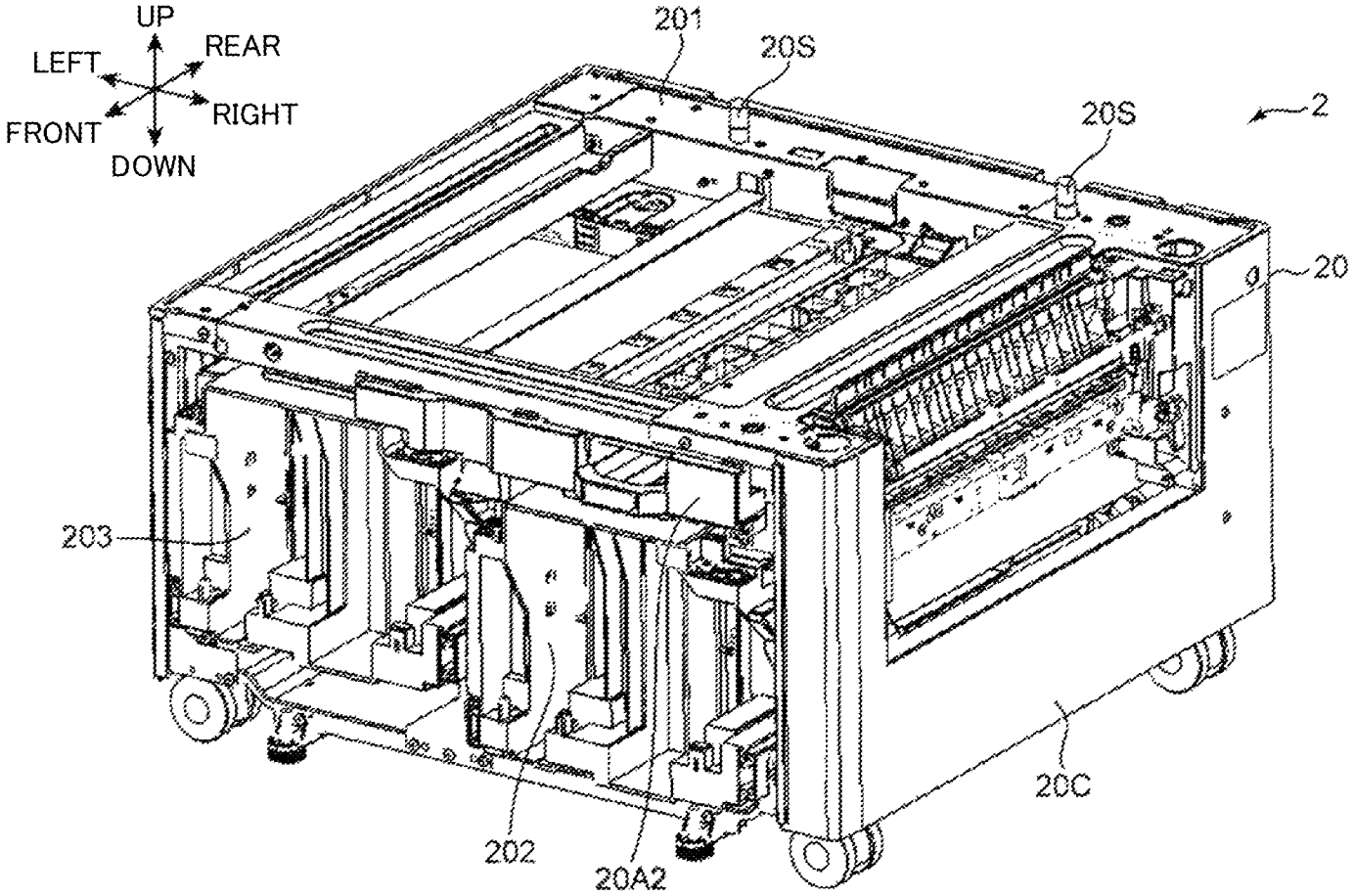
FIG. 2 is a perspective view illustrating an inside of the sheet feed deck according to the embodiment of the present disclosure.
Figure 3:
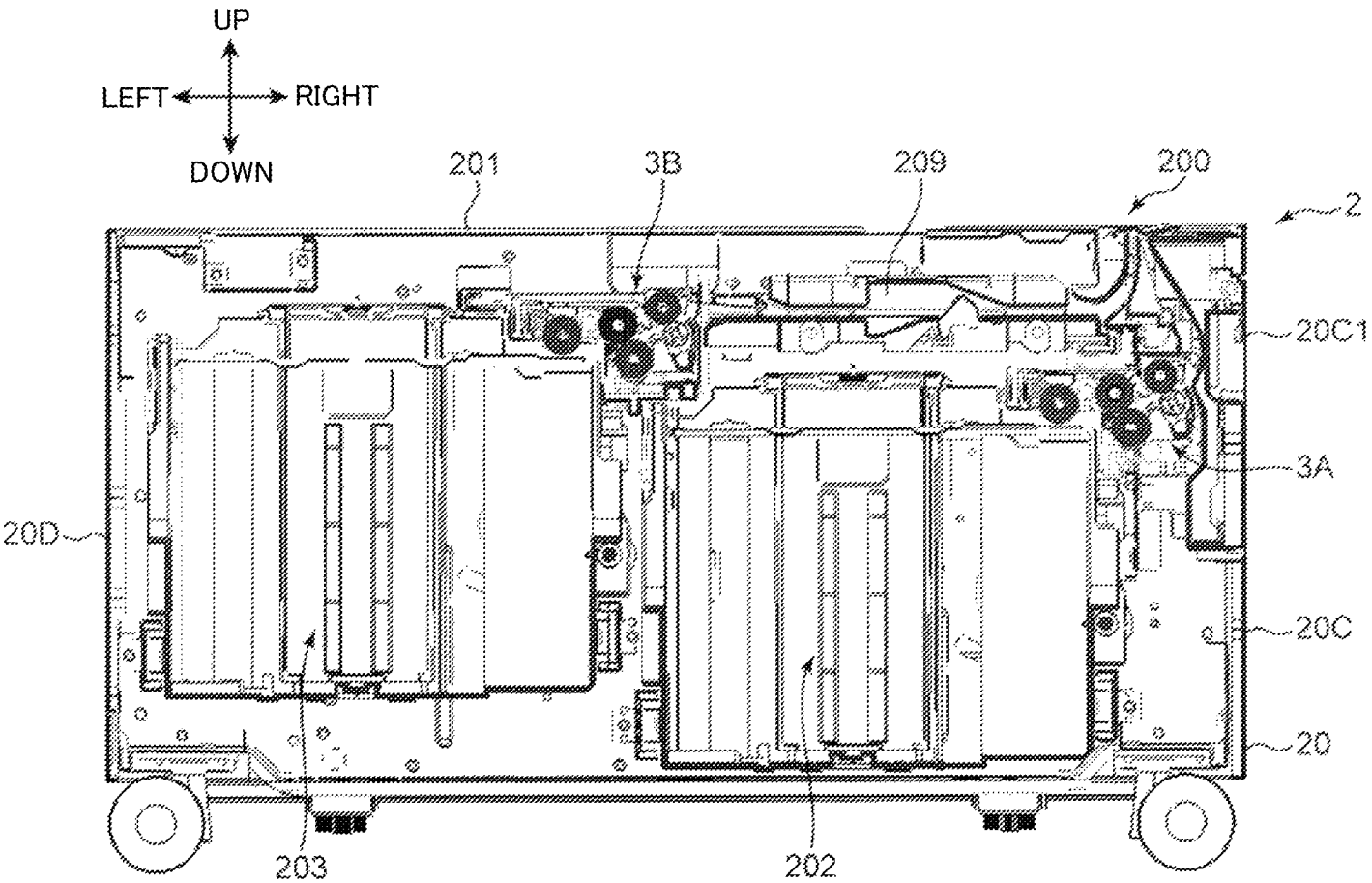
FIG. 3 is a sectional view illustrating the inside of the sheet feed deck according to the embodiment of the present disclosure.
Figure 4:
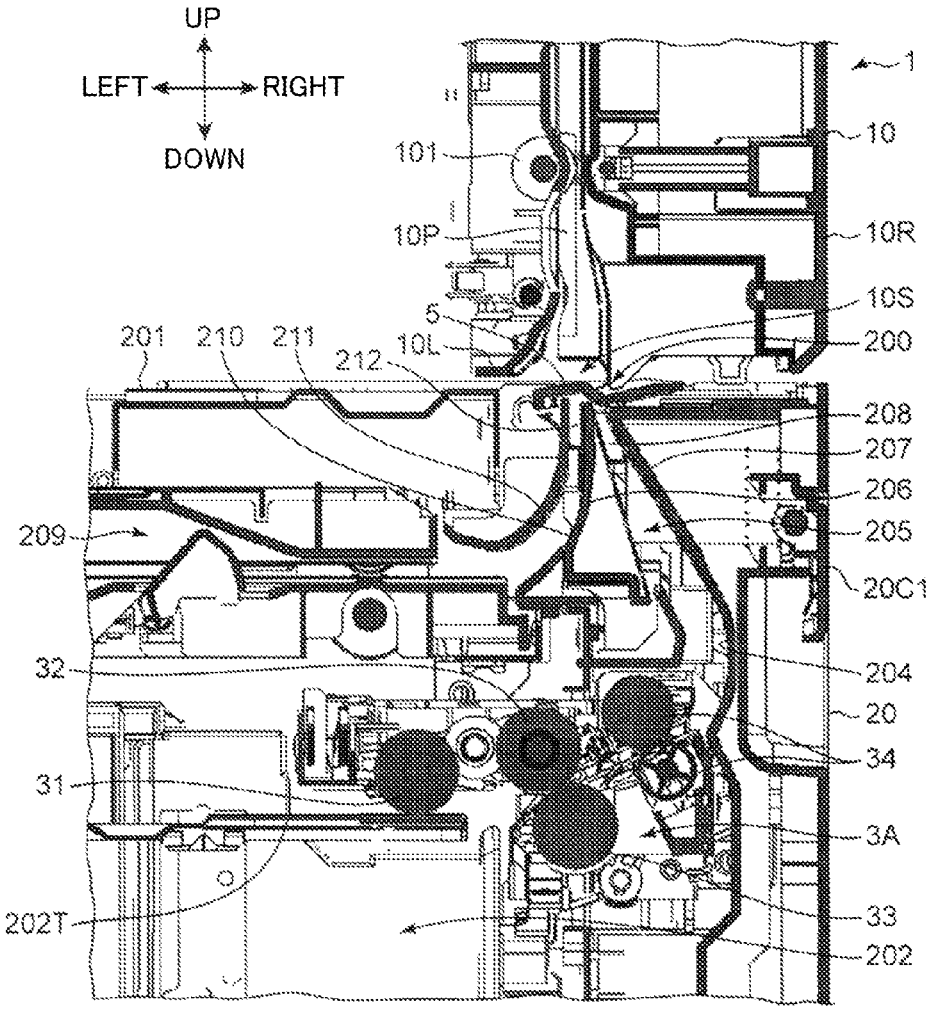
FIG. 4 is a sectional view, which is an enlarged view of a part illustrated in FIG. 3, illustrating a periphery of a guide member when the guide member is located at a first position.

Hereinafter, an embodiment of the present disclosure will be described in detail with reference to the drawings. FIG. 1 is a perspective view of a sheet feed deck 2 (sheet conveying apparatus) according to one embodiment of the present disclosure. FIG. 2 is a perspective view illustrating a state in which a deck front wall 20A and an opening/closing cover 20C1, which are described later, are removed. FIG. 3 is a sectional view illustrating an internal structure of the sheet feed deck 2. FIG. 4 is an enlarged sectional view illustrating a part of an image forming apparatus 1 and the sheet feed deck 2.

The sheet feed deck 2 stores sheets inside, is mounted to a predetermined sheet processing apparatus, and conveys the sheets to the sheet processing apparatus.

Figure 10:
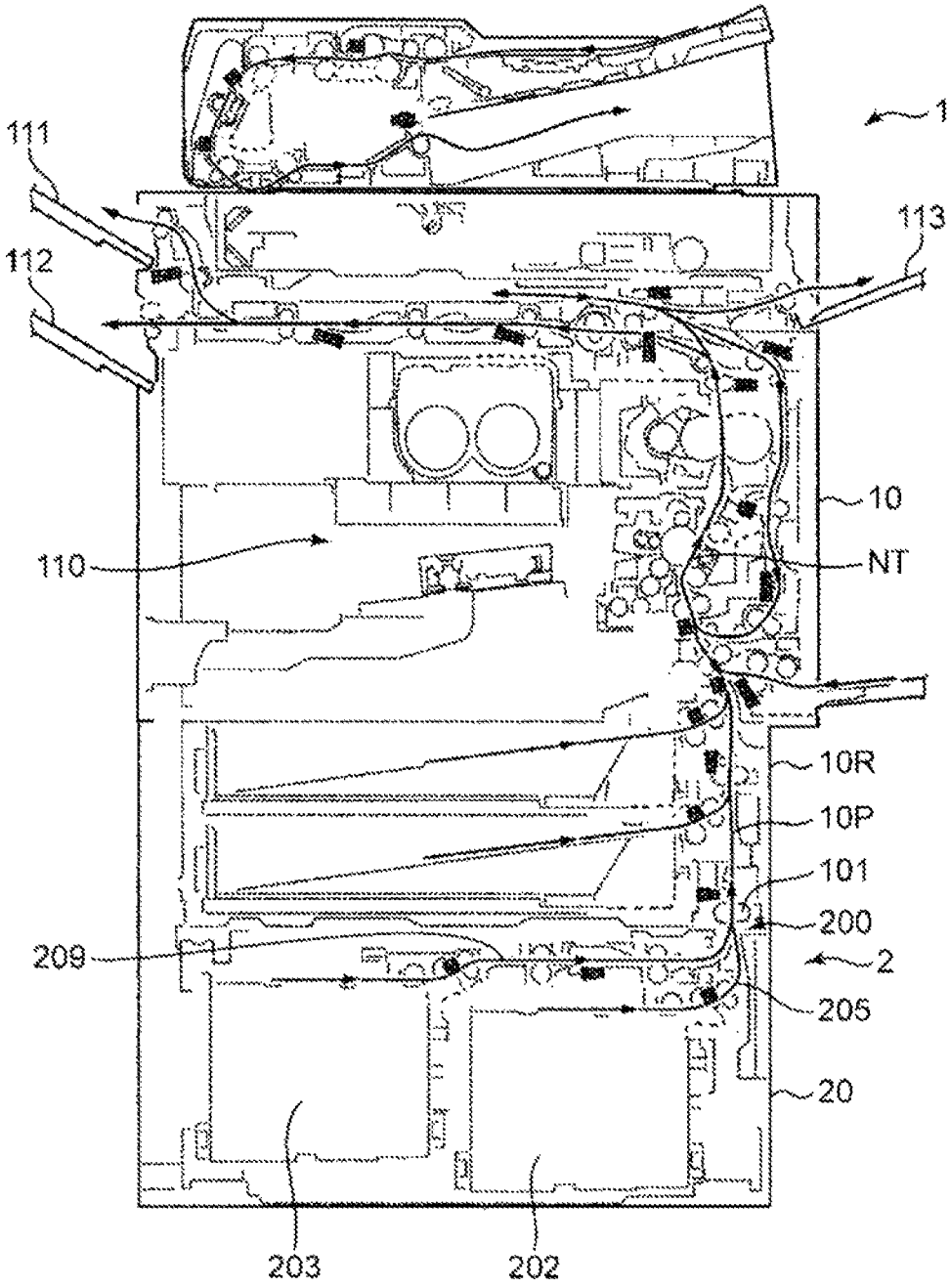
FIG. 10 is a sectional view illustrating a state in which the sheet feed deck is mounted to an image forming apparatus according to the embodiment of the present disclosure.

In the present embodiment, the image forming apparatus 1 (sheet processing apparatus) is employed as the apparatus to which the sheet feed deck 2 is mounted. FIG. 10 is a sectional view illustrating a state in which the sheet feed deck 2 is attached to a lower part of the image forming apparatus 1. The image forming apparatus 1 receives a sheet from the sheet feed deck 2, and forms an image on the sheet. The image forming apparatus 1 includes an image forming portion 110 (sheet processing portion). A known image forming technique such as an electrophotographic manner or an ink jet manner is employed for the image forming portion. The image forming apparatus 1 also has an apparatus body 10. The apparatus body 10 has a shape of almost a rectangular parallelepiped. As illustrated in FIG. 4, the apparatus body 10 includes a body bottom wall 10L (bottom portion) including an insertion portion 10S (opening portion), and a main sheet conveying path 10P which extends upward from the insertion portion 10S and on which sheets are conveyed. The insertion portion 10S is an opening portion formed on the body bottom wall 10L. A body conveying roller 101 is arranged on the main sheet conveying path 10P. When the sheet feed deck 2 is mounted to the apparatus body 10, a sheet is conveyed into the main sheet conveying path 10P through the insertion portion 10S. An image is formed on the sheet conveyed by the body conveying roller 101, on a transfer nip portion NT of the image forming portion 110, and then, this sheet is discharged onto any one of sheet discharge portions 111, 112, and 113.

Referring to FIG. 1, the sheet feed deck 2 includes a deck body 20 (housing). The deck body 20 has a shape of almost a rectangular parallelepiped. The deck body 20 includes a deck front wall 20A, a deck rear wall 20B, a deck right wall 20C, a deck left wall 20D, a top face portion 201 (top face portion), a sheet feed portion 200, and a positioning portion 20S.

The deck front wall 20A is a wall portion defining a front face of the deck body 20. The deck front wall 20A includes a grip portion 20U. When an operator grips the grip portion 20U, the deck front wall 20A, and a first storage portion 202 and a second storage portion 203, which are described later, are drawn forward from the deck body 20. The deck rear wall 20B is a wall portion defining a rear face of the deck body 20. Similarly, the deck right wall 20C and the deck left wall 20D are wall portions defining a right face and a left face of the deck body 20.

The top face portion 201 defines a top face of the deck body 20. In other words, the top face portion 201 forms the top face of the deck body 20. When the sheet feed deck 2 is mounted to the apparatus body 10 of the image forming apparatus 1, the top face portion 201 is arranged opposing the body bottom wall 10L of the apparatus body 10.

The sheet feed portion 200 is an opening portion formed at the right end on the top face portion 201. The sheet feed portion 200 extends in a front-rear direction so as to correspond to the widthwise direction of the sheet, and the sheet is discharged from the sheet feed portion 200.

The positioning portion 20S is a pair of projecting portions arranged to have a space therebetween in the horizontal direction at the rear end portion on the top face portion 201. The positioning portion 20S is inserted into an insertion hole, not illustrated, on the apparatus body 10. The position of the deck body 20 and the position of the apparatus body 10 are determined by the positioning portion 20S and the insertion hole.

Referring to FIGS. 2 and 3, the sheet feed deck 2 also includes the first storage portion 202 (sheet storage portion), the second storage portion 203 (sheet storage portion), a first conveying portion 3A, and a second conveying portion 3B. The first storage portion 202 and the second storage portion 203 are arranged adjacent to each other in the horizontal direction in the deck body 20. The first storage portion 202 and the second storage portion 203 have almost a box-like shape, and store sheets inside. In this case, the sheets are stored as being stacked in the up-down direction. The first conveying portion 3A and the second conveying portion 3B feed the sheets stored in the first storage portion 202 and the second storage portion 203 to the sheet feed portion 200.

Referring to FIG. 4, the first conveying portion 3A includes a pickup roller 31, a sheet feed roller 32, a retard roller 33, and a pair of conveying rollers 34. A lifting plate 202T is arranged on the first storage portion 202 described above.

The pickup roller 31 comes in contact with the sheet surface of the sheet stored in the first storage portion 202, and feeds the sheet downstream in the sheet conveying direction. The sheet feed roller 32 is arranged downstream from the pickup roller 31 in the sheet conveying direction, and conveys the sheets, one by one, on the uppermost position of the sheets fed by the pickup roller 31. The retard roller 33 forms a sheet feed nip portion with the sheet feed roller 32. The retard roller 33 prevents the sheets other than the sheet on the uppermost position from being conveyed from the sheet feed nip portion. The pair of the conveying rollers 34 is a pair of conveying rollers arranged downstream from the sheet feed nip portion in the sheet conveying direction. The pair of the conveying rollers 34 further conveys the sheet conveyed by the sheet feed roller 32 to the sheet feed portion 200. The lifting plate 202T is a plate member arranged in the first storage portion 202. The sheets are stacked onto the lifting plate 202T. The lifting plate 202T is movable in the vertical direction by a drive portion not illustrated. By the elevating motion of the lifting plate 202T, the sheet surface of the sheet stored in the first storage portion 202 is brought into contact with the pickup roller 31.

As illustrated in FIG. 3, the second conveying portion 3B that feeds the sheets stored in the second storage portion 203 has the configuration similar to that of the first conveying portion 3A.

As illustrated in FIG. 4, the sheet feed deck 2 also includes a first wall portion 204, a first sheet conveying path 205 (sheet conveying path), a second wall portion 206, a third wall portion 207, and a first outlet portion 208 (outlet portion). The sheet feed deck 2 also includes a second sheet conveying path 209 (sheet conveying path), a fourth wall portion 210, a fifth wall portion 211 (wall portion), and a second outlet portion 212 (outlet portion).

The first wall portion 204 is a wall portion extending in the up-down direction to the right of the pair of the conveying rollers 34. The sheet conveyed by the pair of the conveying rollers 34 is guided upward by the first wall portion 204. The first sheet conveying path 205 is a conveying path extending from the first storage portion 202 to the top face portion 201. The first sheet conveying path 205 can communicate with the main sheet conveying path 10P of the apparatus body 10. The first sheet conveying path 205 extends to the right from the first storage portion 202, and then, extends upward. The second wall portion 206 is a wall portion defining a region, at the side close to the top face portion 201, of the first sheet conveying path 205. The second wall portion 206 defines a left side of the first sheet conveying path 205. The second wall portion 206 extends almost in the up-down direction. The third wall portion 207 is a wall portion defining a region, at the side close to the top face portion 201, of the first sheet conveying path 205. The third wall portion 207 is connected with an upper end portion of the first wall portion 204. The third wall portion 207 defines a right side of the first sheet conveying path 205, and guides the sheet in the upper-left direction. The first wall portion 204 and the third wall portion 207 correspond to a left wall portion of the opening/closing cover 20C1. The top face portion 201 includes the first outlet portion 208. The first outlet portion 208 is arranged on the first sheet conveying path 205 in the vicinity of the top face of the deck body 20 defined by the top face portion 201. The sheet is discharged to the outside of the deck body 20 from the first outlet portion 208. The first outlet portion 208 corresponds to a part of the above-described sheet feed portion 200.

The second sheet conveying path 209 is a conveying path extending from the second storage portion 203 to the top face portion 201. The second sheet conveying path 209 can communicate with the main sheet conveying path 10P on the apparatus body 10. The second sheet conveying path 209 extends to the right from the second storage portion 203, and then, extends upward. The fourth wall portion 210 is a wall portion defining a region, extending upward, of the second sheet conveying path 209, in other words, a region, at the side close to the top face portion 201, of the second sheet conveying path 209. The fourth wall portion 210 defines a right side of the second sheet conveying path 209. The above-described second wall portion 206 and the fourth wall portion 210 are wall portions made of the same member, and correspond respectively to a right side face and a left side face of the wall portion. The fifth wall portion 211 is arranged on the deck body 20. The fifth wall portion 211 is a wall portion defining a region, at the side close to the top face portion 201, of the second sheet conveying path 209. The fifth wall portion 211 defines a left side of the second sheet conveying path 209. The fifth wall portion 211 will be described later in detail. The top face portion 201 includes the second outlet portion 212. The second outlet portion 212 is arranged on the second sheet conveying path 209 in the vicinity of the top face of the deck body 20 defined by the top face portion 201. The sheet is discharged to the outside of the deck body 20 from the second outlet portion 212. The second outlet portion 212 is arranged adjacent to the first outlet portion 208, and corresponds to a part of the above-described sheet feed portion 200.

As described above, in the present embodiment, the first sheet conveying path 205 and the second sheet conveying path 209 are adjacent to each other and exposed to the outside on the top face portion 201. The sheet feed portion 200 described above is composed of the first outlet portion 208 and the second outlet portion 212. The sheet is conveyed from the sheet feed portion 200 toward the outside of the deck body 20. Accordingly, the sheets stored in two sheet storage portions (the first storage portion 202 and the second storage portion 203) are conveyed into the apparatus body 10 through the common sheet feed portion 200.

The deck body 20 also includes the opening/closing cover 20C1 (see FIGS. 1 and 3). The opening/closing cover 20C1 can be opened and closed relative to the deck right wall 20C (the side face of the housing) of the deck body 20 about its lower end. Specifically, the opening/closing cover 20C1 can be changed between an open state in which the opening/closing cover 20C1 is opened relative to the deck body 20 to expose the region of the first sheet conveying path 205 close to the top face portion 201 (the first outlet portion 208) and a close state in which the opening/closing cover 20C1 defines a part of the first sheet conveying path 205. As illustrated in FIG. 4, in particular, the first outlet portion 208 is exposed at the right side of the deck body 20 by opening the opening/closing cover 20C1 to the right, even if the apparatus body 10 and the deck body 20 are coupled to each other in the up down direction.

Figure 5:
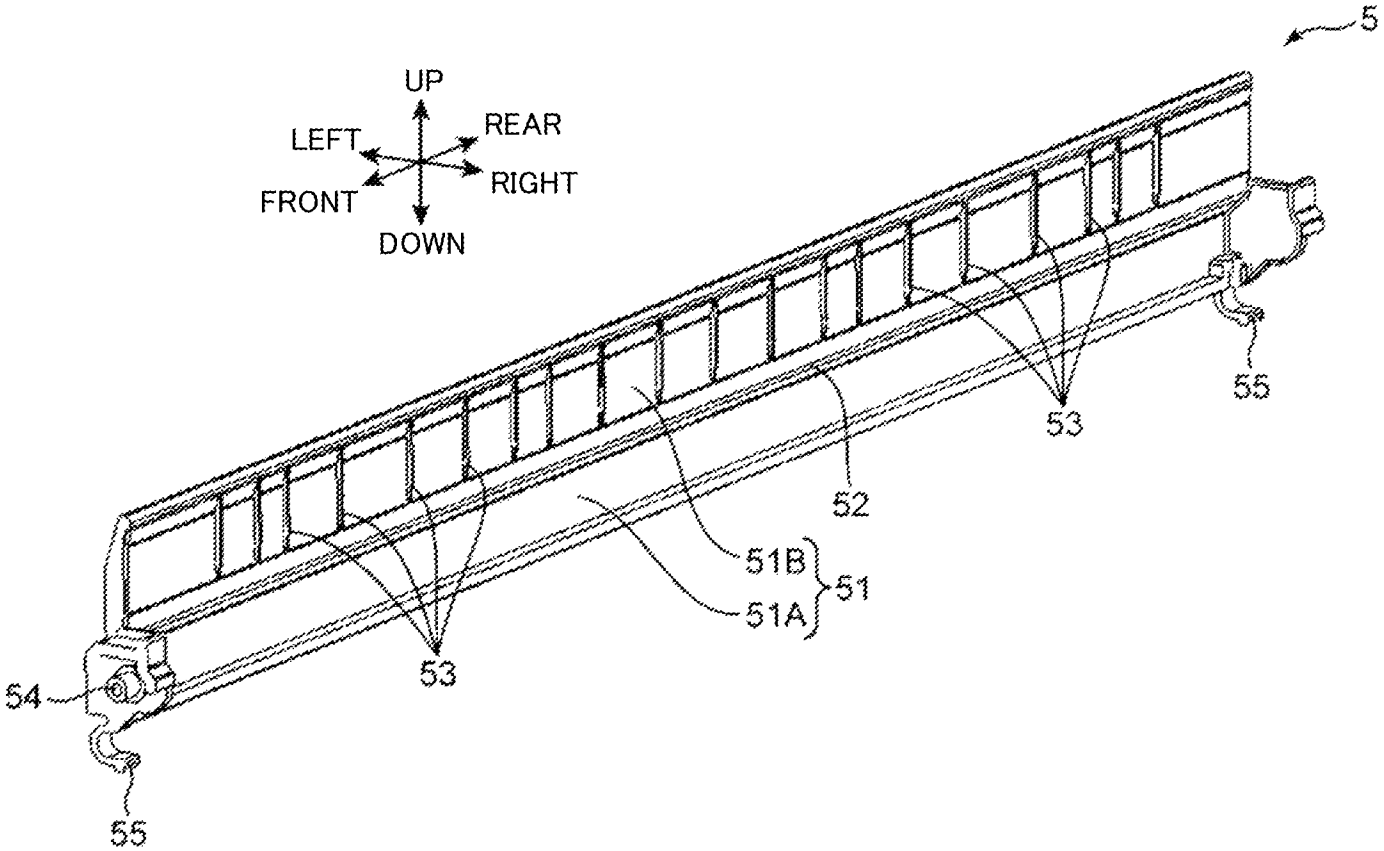
FIG. 5 is a perspective view of the guide member according to the embodiment of the present disclosure.
Figure 6:
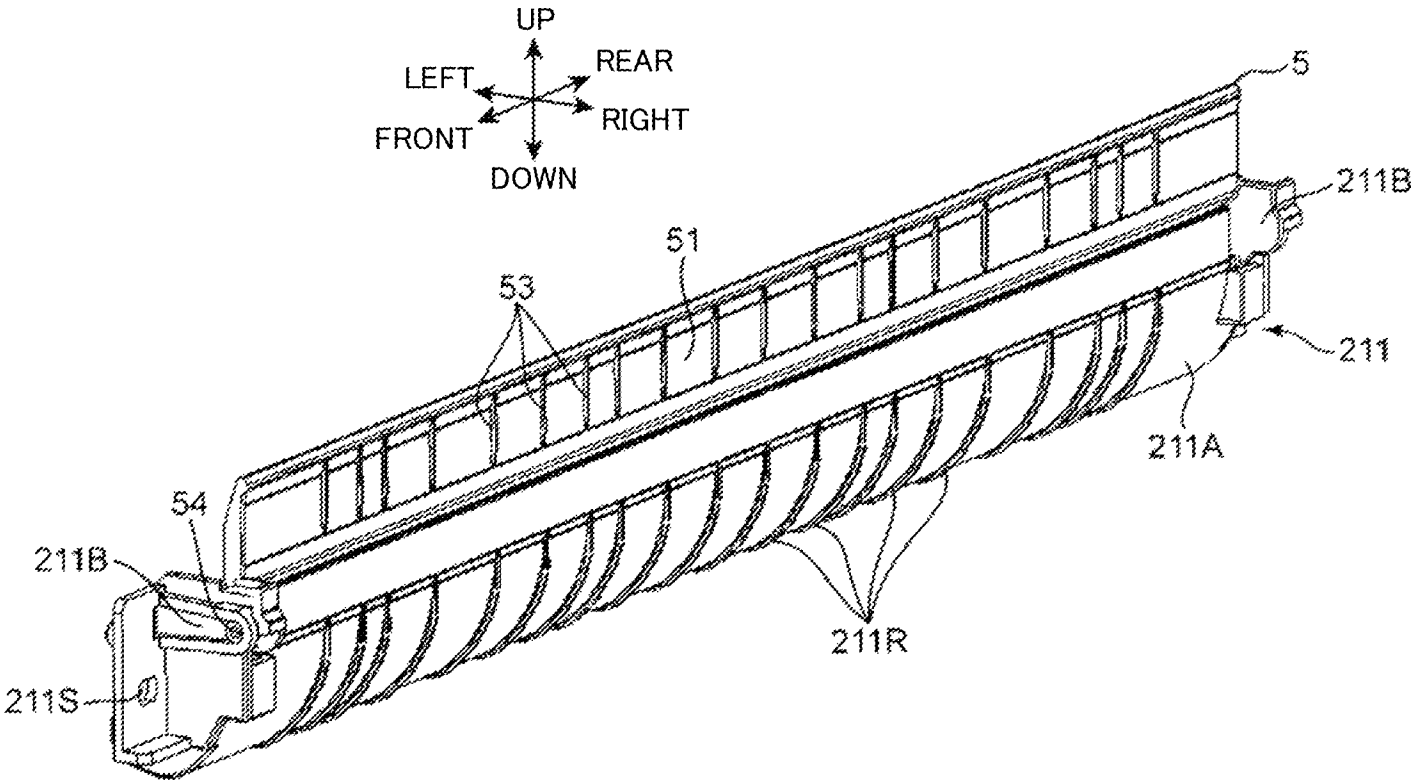
FIG. 6 is a perspective view of the guide member that is supported by a wall portion according to the embodiment of the present disclosure.

In addition, the sheet feed deck 2 includes a guide member 5. FIG. 5 is a perspective view illustrating the guide member according to the present embodiment. FIG. 6 is a perspective view of the guide member 5 in a state in which the guide member 5 is supported by the fifth wall portion 211. Referring to FIG. 4, the guide member 5 is arranged above the first outlet portion 208 and the second outlet portion 212. Specifically, the guide member 5 is pivotably supported by the above fifth wall 211.

Referring to FIG. 5, the guide member 5 includes a plate portion 51, a connection portion 52, a plate rib 53, a plate shaft portion 54 (pivot portion), and an antirotation member 55.

The plate portion 51 is a body portion of the guide member 5. The plate portion 51 includes a plate member extending in the front-rear direction. The plate portion 51 includes a support portion 51A and an extending portion 51B. In the state illustrated in FIG. 5, the support portion 51A corresponds to a lower part of the plate portion 51. The extending portion 51B extends upward from the support portion 51A. The extending portion 51B has a function of guiding a sheet. In the state illustrated in FIG. 5, the extending portion 51B is arranged to project to the right from the support portion 51A. In other words, the support portion 51A and the extending portion 51B are consecutively provided with a predetermined step. The connection portion 52 corresponds to the step portion, and consecutively connects the support portion 51A and the extending portion 51B in the front-rear direction. The plate rib 53 is a rib provided to extend in the up-down direction on the extending portion 51B. Plural plate ribs 53 are provided with a space in the front-rear direction. The plate rib 53 has a function of reducing friction force applied to the sheet when the extending portion 51B guides the sheet. Each plate shaft portion 54 is a shaft member provided to project from each end of the support portion 51A in the front-rear direction. The plate shaft portion 54 serves as a pivot point of the pivot movement of the guide member 5. In other words, the plate portion 51 described above is a plate member provided to project from a rotation axis, formed by a pair of the plate shaft portions 54, in the diameter direction of the rotation of the rotation axis. Each antirotation member 55 projects from each end of the support portion 51A below the plate shaft portion 54. The antirotation member 55 is an arc-like member. The antirotation member 55 comes in contact with a part of the fifth wall portion 211 to position the guide member 5 at a predetermined location in the rotating direction, when the guide member 5 is pivoted.

Referring to FIG. 6, the above fifth wall portion 211 includes a guide face 211A, a side wall 211B, a guide rib 211R, and a fixing portion 211S.

The guide face 211A is a right side face of the fifth wall portion 211. As illustrated in FIG. 6, the guide face 211A has a curved shape. The guide face 211A defines a region, at the side close to the top face portion 201, of the above-described second sheet conveying path 209, and guides the conveyance of the sheet. The side walls 211B are provided on both end portions of the guide face 211A in the front-rear direction. The side wall 211B has almost an L-shape as viewed from above. The plate shaft portion 54 of the guide member 5 is inserted into an insertion hole, not illustrated, formed on the side wall 211B. Thus, the guide member 5 is pivotably supported by the fifth wall portion 211. In the state illustrated in FIG. 6, the antirotation member 55 (see FIG. 5) of the guide member 5 is in contact with the backside (the left face of the fifth wall portion 211) of the guide face 211A. Therefore, the leftward rotation of the plate portion 51 from the state illustrated in FIG. 6 is restricted by the antirotation member 55. The fixing portion 211S is a hole portion formed on a region of a pair of the side walls 211B facing in the horizontal direction. The fifth wall portion 211 is fixed to an inner wall portion (not illustrated) of the deck body 20 by inserting a screw, not illustrated, into the fixing portion 211S.

Figure 7:
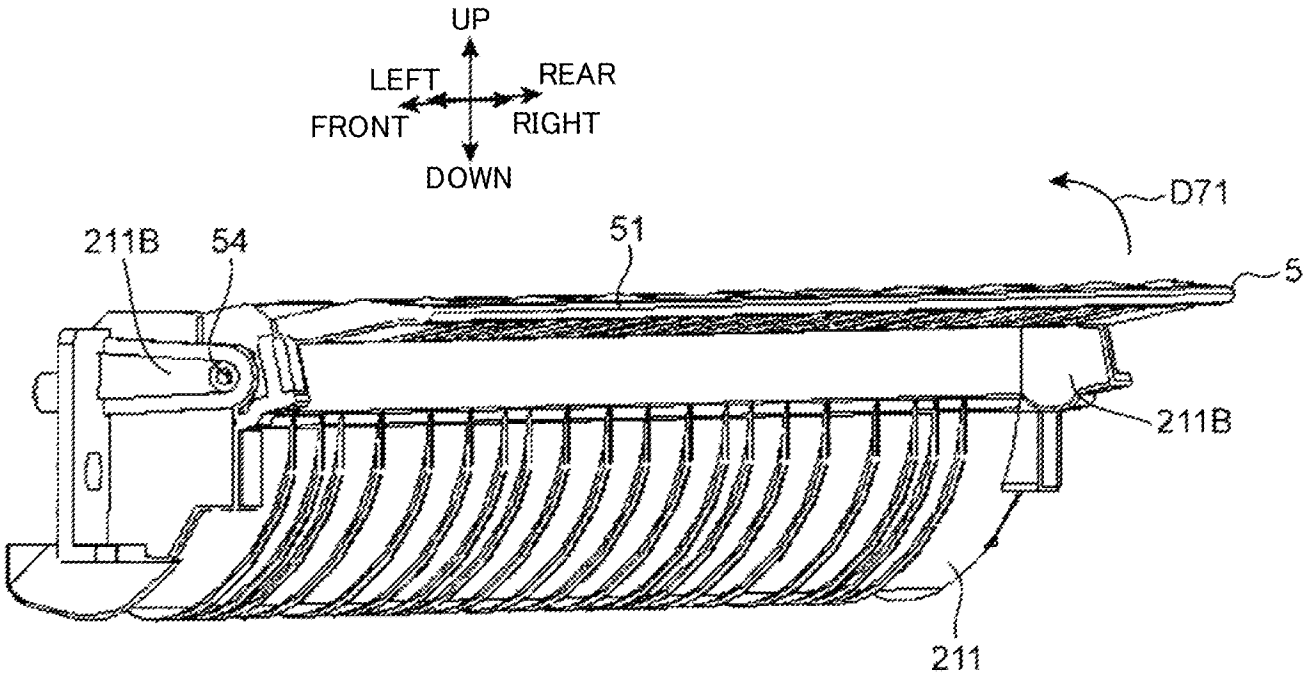
FIG. 7 is a perspective view illustrating a state in which the guide member is located at the first position according to the embodiment of the present disclosure.
Figure 8:
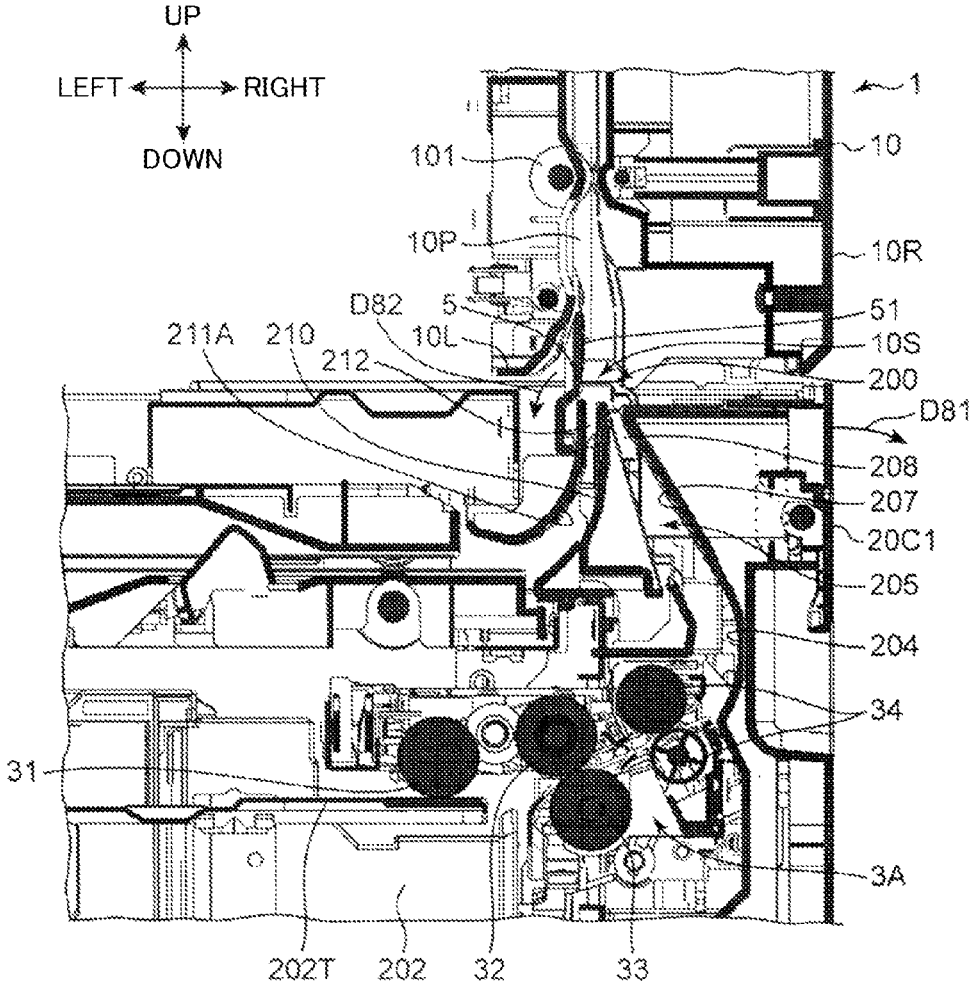
FIG. 8 is a sectional view illustrating a periphery of the guide member when the guide member is located at a second position according to the embodiment of the present disclosure.
Figure 9:
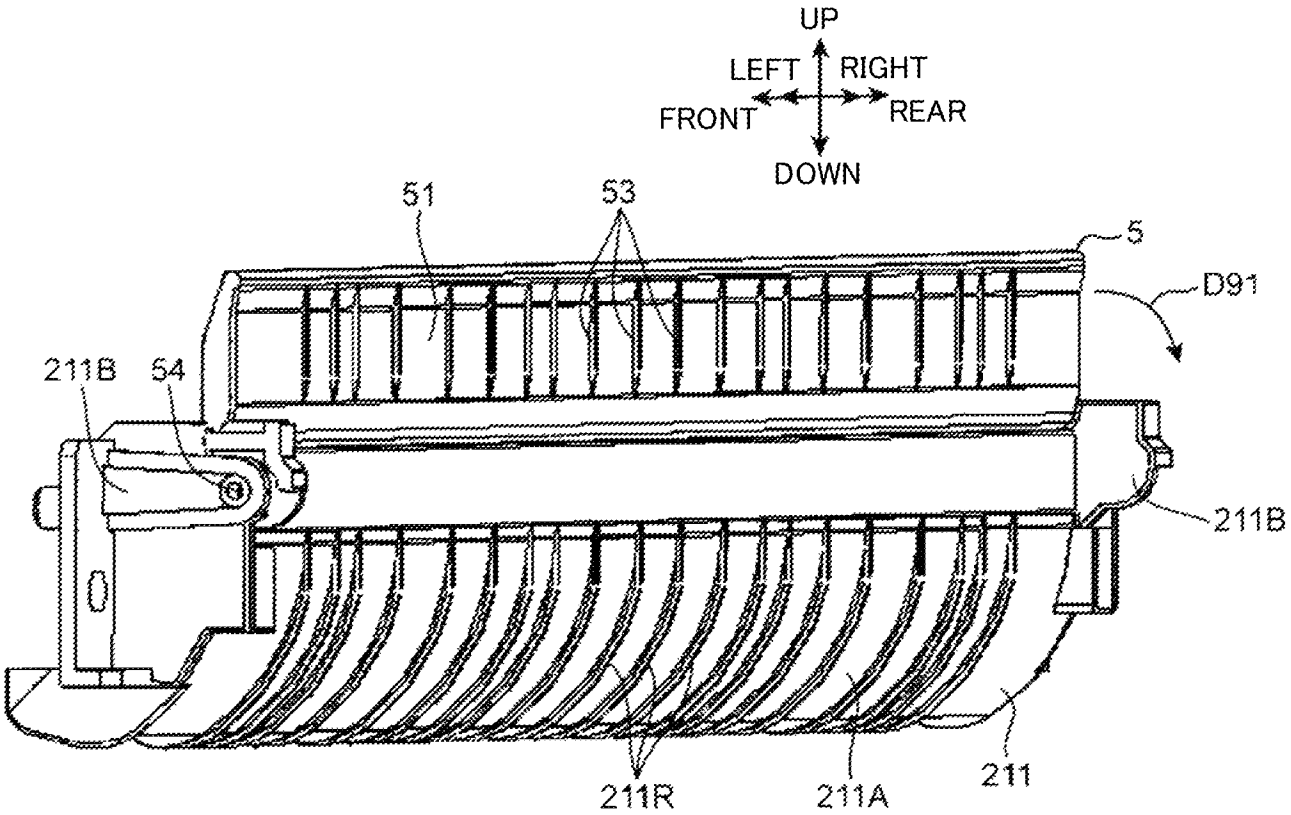
FIG. 9 is a perspective view illustrating a state in which the guide member is located at the second position according to the embodiment of the present disclosure.

Subsequently, an operation of the guide member 5 according to the present embodiment will be described. As described above, the guide member 5 is pivotably supported on the deck body 20 through the fifth wall portion 211. The guide member 5 can change its position between a first position and a second position. The first position is the position where the guide member 5 follows along the top face portion 201. The second position is the position where the guide member 5 projects upward from the top face portion 201 to guide a sheet to the main sheet conveying path 10P from the first sheet conveying path 205 and the second sheet conveying path 209. FIG. 4 is a sectional view illustrating a periphery of the guide member 5 in the state in which the guide member 5 is located at the first position. FIG. 7 is a perspective view of the guide member 5 located at the first position. On the other hand, FIG. 8 is a sectional view illustrating a periphery of the guide member 5 in the state in which the guide member 5 is located at the second position. FIG. 9 is a perspective view of the guide member 5 located at the second position.

When the guide member 5 is located at the first position illustrated in FIGS. 4 and 7, the guide member 5 extends to the right along the top face portion 201 of the deck body 20. In other words, the plate portion 51 of the guide member 5 forms a part of the top face portion 201. Since the guide member 5 is conventionally in a state of projecting upward from the top face portion 201 of the deck body 20, the guide member 5 collides with the apparatus body 10 to cause damage on the guide member 5 during a coupling operation of mounting and fixing the apparatus body 10 onto the deck body 20. However, in the present embodiment, the guide member 5 follows along the top face portion 201 as described above, whereby the collision of the apparatus body 10 with the guide member 5 during the mounting of the apparatus body 10 onto the deck body 20 is prevented. As a result, the damage on the guide member 5 caused by the collision can be prevented.

In addition, as illustrated in FIG. 4, the guide member 5 located at the first position covers the region above the first outlet portion 208 and the second outlet portion 212 (the region, which is exposed to the outside on the top face portion 201, of the first sheet conveying path 205 and the second sheet conveying path 209). Therefore, an intrusion of foreign matters into the first sheet conveying path 205 and the second sheet conveying path 209 is prevented, when the deck body 20 is stored alone, or when the apparatus body 10 is stacked onto the deck body 20.

On the other hand, when the apparatus body 10 is mounted and fixed onto the deck body 20 with the guide member 5 being located at the first position, the guide member 5 is located at the second position illustrated in FIGS. 8 and 9. In the present embodiment, when the guide member 5 is located at the second position, the opening/closing cover 20C1 is changed to be in the open state relative to the deck body 20 as indicated by an arrow D81 in FIG. 8. Specifically, the opening/closing cover 20C1 is opened. Since the third wall portion 207 is opened together with the opening/closing cover 20C1, the first sheet conveying path 205 is exposed at the right side of the deck body 20. Accordingly, when an operator presses the guide member 5 through the exposed first sheet conveying path 205, the guide member 5 is pivoted about the plate shaft portion 54 (see FIG. 5) (an arrow D71 in FIG. 7). As a result, the guide member 5 is moved to the second position (see FIGS. 8 and 9) from the first position (see FIGS. 4 and 7). With this, the operator can move the guide member 5 from the first position to the second position by accessing to the guide member 5 from the exposed first sheet conveying path 205, whereby the position of the guide member 5 can be changed with the guide member 5 being appropriately prevented from being damaged after the deck body 20 is mounted on the apparatus body 10.

The guide member 5 located at the second position enters the main sheet conveying path 10P from the insertion portion 10S of the apparatus body 10. Therefore, the sheet discharged from the first sheet conveying path 205 and the second sheet conveying path 209 is surely guided to the main sheet conveying path 10P through the guide member 5. In addition, in the present embodiment, the plate portion 51 (a part of the guide member 5) of the guide member 5 located at the second position follows along the guide face 211A of the fifth wall portion 211 as illustrated in FIGS. 8 and 9. In other words, the downstream side of the second sheet conveying path 209 and the upstream side of the main sheet conveying path 10P are defined with the plate portion 51 and the guide face 211A being arranged flush with each other. Consequently, the sheet is conveyed into the main sheet conveying path 10P, while being stably guided along the guide member 5 from the guide face 211A of the fifth wall portion 211.

When the apparatus body 10 is removed again from the deck body 20 by the operator, the operator pivots the guide member 5 in a direction of an arrow D91 in FIG. 9. With this operation, the guide member 5 is arranged along the top face portion 201, and the first sheet conveying path 205 and the second sheet conveying path 209 at the side close to the top face portion 210 are appropriately closed by the guide member 5.

The sheet feed deck 2 and the image forming apparatus 1 provided with the same according to the embodiment of the present disclosure are described above. However, the present disclosure is not limited thereto. For example, modifications described below may be implemented.

In the embodiment described above, the guide member 5 is pivoted in the direction of the arrow D71 in FIG. 7 and in the direction of the arrow D91 in FIG. 9. However, the present disclosure is not limited thereto. The guide member 5 may be pivoted in a direction of an arrow D82 in FIG. 8. In this case, the function of closing the first sheet conveying path 205 and the second sheet conveying path 209 by the guide member 5 is not always exhibited. However, the damage on the guide member 5 upon the coupling operation is well prevented by the arrangement of the guide member 5 along the top face portion 201.

In the embodiment described above, the operator pivots the guide member 5 after the opening/closing cover 20C1 is opened. However, the present disclosure is not limited thereto. It may be configured such that, in order to enhance workability, not only the opening/closing cover 20C1 but also the body right wall 10R of the apparatus body 10 are opened to the right to expose the right side of the main sheet conveying path 10P to the outside in FIG. 4.

As a modification, in FIGS. 7 and 9, the plate shaft portion 54 inserted into the side wall 211B at the front side of the fifth portion 211 may penetrate the inner wall 20A2 (FIG. 2) of the deck front wall 20A to project to the front, and the operator may rotate the plate shaft portion 54. Alternatively, the guide member 5 may automatically be pivoted by a drive portion not illustrated.

In the embodiment described above, an image is formed on a sheet in the apparatus body 10. However, the present disclosure is not limited thereto. The apparatus body 10 on which the sheet feed deck 2 is mounted may be a relay conveying unit that conveys a sheet to the further downstream side. In this case, the sheet conveyed into the apparatus body 10 from the sheet feed deck 2 is conveyed in a predetermined conveying direction by the body conveying roller 101 (FIG. 4) serving as a sheet processing portion. Other processes may be executed to the sheet in the apparatus body 10.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying apparatus attached to a lower part of an image forming apparatus which includes a bottom portion having an opening portion and a main sheet conveying path which extends upward from the opening portion comprising:

a housing;

a top face portion that forms a top face of the housing, and includes an outlet portion arranged opposing the opening portion;

a sheet storage portion arranged inside the housing and storing sheets therein;

a sheet conveying path which extends from the sheet storage portion to the outlet portion and is configured to be capable of communicating with the main sheet conveying path through the opening portion, in which the sheet is conveyed; and a guide member that is pivotably supported by the housing, and is configured to be capable of changing its position between a first position where the guide member follows along the top face portion and a second position where the guide member projects upward from the top face portion so as to guide the sheet to the main sheet conveying path from the sheet conveying path.

2. The sheet conveying apparatus according to claim 1, wherein the guide member covers the outlet portion at the first position.

3. The sheet conveying apparatus according to claim 2, wherein the sheet storage portion includes a first storage portion and a second storage portion which are arranged adjacent to each other in the housing, the sheet conveying path includes a first sheet conveying path extending from the first storage portion to the outlet portion and a second sheet conveying path extending from the second storage portion to the outlet portion, the first sheet conveying path and the second sheet conveying path are adjacent to each other and exposed to the outside at the outlet portion, and the guide member covers the outlet portion from above at the first position.

4. The sheet conveying apparatus according to claim 1, wherein the guide member enters the main sheet conveying path from the opening portion of the apparatus body to form a part of the main sheet conveying path at the second position.

5. The sheet conveying apparatus according to claim 1, further comprising:

a wall portion arranged in the housing and including a guide face that defines a region, at the side close to the top face portion, of the sheet conveying path, wherein the guide member is pivotably supported on the wall portion, and a part of the guide member follows along the guide face of the wall portion at the second position.

6. The sheet conveying apparatus according to claim 1, further comprising:

an opening/closing cover that is opened relative to a side face of the housing, and is configured to be capable of changing its state between an open state for exposing the sheet conveying path to the outside and a close state for defining a part of the sheet conveying path, wherein the housing is mounted on the bottom portion of the image forming apparatus with the guide member being located at the first position, and the guide member can be changed to the second position from the first position by being pressed through the sheet conveying path that is exposed to the outside by opening the opening/closing cover, in the state in which the housing is mounted on the bottom portion.

7. A sheet processing apparatus comprising:

the sheet conveying apparatus according to claim 1; and a sheet processing portion that can perform a predetermined process to a sheet conveyed by the sheet conveying apparatus.

8. An image forming apparatus comprising:

a sheet conveying apparatus;

an apparatus body including a bottom portion having an opening portion and a main sheet conveying path which extends upward from the opening portion and on which a sheet is conveyed;

an image forming portion that can form an image onto a sheet conveyed by the sheet conveying apparatus; and wherein the sheet conveying apparatus includes:

a housing attached to a lower part of the apparatus body;

a top face portion that forms a top face of the housing, and includes an outlet portion arranged opposing the opening portion;

a sheet storage portion arranged inside the housing and storing sheets therein;

a sheet conveying path which extends from the sheet storage portion to the outlet portion and is configured to be capable of communicating with the main sheet conveying path through the opening portion, in which the sheet is conveyed; and a guide member that is pivotably supported by the housing, and is configured to be capable of changing its position between a first position where the guide member follows along the top face portion and a second position where the guide member projects upward from the top face portion so as to guide the sheet to the main sheet conveying path from the sheet conveying path.

9. The image forming apparatus according to claim 8, wherein the image forming portion is arranged opposing the main sheet conveying path for forming an image onto the sheet.

10. The image forming apparatus according to claim 8, wherein the guide member covers the outlet portion at the first position.

11. The image forming apparatus according to claim 10, wherein the sheet storage portion includes a first storage portion and a second storage portion which are arranged adjacent to each other in the housing, the sheet conveying path includes a first sheet conveying path extending from the first storage portion to the outlet portion and a second sheet conveying path extending from the second storage portion to the outlet portion, the first sheet conveying path and the second sheet conveying path are adjacent to each other and exposed to the outside at the outlet portion, and the guide member covers the outlet portion from above at the first position.

12. The image forming apparatus according to claim 8, wherein the guide member enters the main sheet conveying path from the opening portion of the apparatus body to form a part of the main sheet conveying path at the second position.

13. The image forming apparatus according to claim 8, further comprising:

a wall portion arranged in the housing and including a guide face that defines a region, at the side close to the top face portion, of the sheet conveying path, wherein the guide member is pivotably supported on the wall portion, and a part of the guide member follows along the guide face of the wall portion at the second position.

14. The image forming apparatus according to claim 8, further comprising:

an opening/closing cover that is opened relative to a side face of the housing, and is configured to be capable of changing its state between an open state for exposing the sheet conveying path to the outside and a close state for defining a part of the sheet conveying path, wherein the housing is mounted on the bottom portion of the apparatus body with the guide member being located at the first position, and the guide member can be changed to the second position from the first position by changing the opening/closing cover to the open state and by being pressed through the sheet conveying path that is exposed to the outside, in the state in which the housing is mounted on the bottom portion.

* * * * *